US008991791B2

(12) United States Patent
Wright et al.

(10) Patent No.: US 8,991,791 B2
(45) Date of Patent: Mar. 31, 2015

(54) HOIST SPOOLING ASSEMBLY AND METHODS OF USING SAME

(71) Applicant: Longyear TM, Inc., South Jordan, UT (US)

(72) Inventors: Christopher Wright, Salt Lake City, UT (US); Joshua Byron, Murray, UT (US)

(73) Assignee: Longyear TM, Inc., South Jordan, UT (US)

( * ) Notice: Subject to any disclaimer, the term of this patent is extended or adjusted under 35 U.S.C. 154(b) by 159 days.

(21) Appl. No.: 13/728,409

(22) Filed: Dec. 27, 2012

(65) Prior Publication Data

US 2014/0183428 A1 Jul. 3, 2014

(51) Int. Cl.
*B66D 1/00* (2006.01)
*B66D 1/36* (2006.01)

(52) U.S. Cl.
CPC ..... *B66D 1/36* (2013.01)
USPC ..... 254/333; 254/383

(58) Field of Classification Search
USPC ..... 254/333, 383, 385, 271, 326
See application file for complete search history.

(56) References Cited

U.S. PATENT DOCUMENTS

| | | | | |
|---|---|---|---|---|
| 2,625,373 | A * | 1/1953 | Hunt | 254/333 |
| 5,669,575 | A * | 9/1997 | Byle | 242/470 |
| 7,478,795 | B2 * | 1/2009 | Grapes et al. | 254/333 |
| 2008/0061277 | A1 | 3/2008 | Grapes et al. | |

FOREIGN PATENT DOCUMENTS

| | | | |
|---|---|---|---|
| JP | 2008059190 | A | 3/1996 |
| JP | 2004250155 | A | 9/2004 |
| JP | 2005247477 | A | 9/2005 |
| KR | 20120063054 | A | 6/2012 |

OTHER PUBLICATIONS

International Search Report and the Written Opinion of the International Search Aurthority for International Application No. PCT/US2012/071790 (mailed Sep. 4, 2013).

* cited by examiner

*Primary Examiner* — Emmanuel M Marcelo
*Assistant Examiner* — Angela Caligiuri
(74) *Attorney, Agent, or Firm* — Ballard Spahr LLP

(57) ABSTRACT

A hoist spooling assembly for spooling a cable about a drum while preventing relative movement between the cable and the drum. The hoist spooling assembly evenly delivers force from a roller to the cable while reducing the incidence of spooling problems, including mechanical wear of the cable and formation of loops and kinks in the cable.

20 Claims, 6 Drawing Sheets

HOIST SPOOLING ASSEMBLY AND METHODS OF USING SAME

FIELD

This application relates generally to apparatus and methods for spooling a cable about a drum and, more particularly, to a hoist spooling assembly for spooling a cable about a drum.

BACKGROUND

Poor hoist spooling can be characterized by the presence of gaps between cable wraps, multiple cable layers on a drum designed for single-layer cable wrapping, mechanical cable damage, reduced productivity, reduced cable life, and/or operator injury. Mechanical damage to a cable can be caused by "bird-caging" and formation of loops and/or kinks.

These problems often arise when a hoist spooling assembly is used to lift or lower a drill string. As a drill string is lowered into a drill hole, its velocity will sometimes decelerate relative to the constant velocity of the cable line of the main line hoist. This deceleration can be attributed to an obstruction or to the viscous effects of drilling mud or water in the drill hole. This change in relative velocities can result in an excess amount of cable, which, in turn, can lead to formation of a loop. If such a loop is pulled through the hoist spooling assembly, a kink can form, thereby damaging the cable such that the cable is unfit for service. Kinks of this kind often form when the hoist operator stops activating the winch and the drill string breaks free of the obstruction, thereby allowing the full weight of the drill string to be applied to the cable with loops present. If the loops are large enough, then they can also get caught on—and irreparably damage—any tensioning mechanisms or encoders of the assembly. Slack in the cable can also arise when there are gaps between cable wraps. When these gaps occur, the length of the cable in a single wrap is longer than the length of the cable in a properly spooled wrap. Thus, when the cable shifts laterally on the drum, the extra length creates slack that can cause damage as described herein.

When a hoist is used to lift the drill string, a hoist plug must typically be threaded on the drill rods. Often, the hoist plug is lowered into the drill string with an excessive amount of unwound cable having little or no tension. Subsequent activation of the hoist can cause a sudden application of tension force to the cable, which is typically at a fleet angle of 1 to 2 degrees relative to a center of the drum. This sudden application of force can result in a side load that forces the cable to "jump" towards the center of the drum, thereby creating a gap. Over time, these spooling errors can perpetuate until the rope is damaged or until the operators are required to re-spool the rope, which can result in severe operator injury.

Accordingly, there is a need in the pertinent art for apparatus and methods for preventing relative motion between a cable and a drum, optimizing the interface between a roller and the cable, and improving the overall functionality and robustness of a hoist spooling assembly in drilling applications.

SUMMARY

Described herein is a hoist spooling assembly for spooling a cable about a drum. The hoist spooling assembly can include a frame having a base portion and first and second spaced support portions. The base portion of the frame has a top surface. The first and second support portions of the frame can extend upwardly from the top surface of the base portion and define respective openings.

The hoist spooling assembly also includes a rod having a longitudinal axis and opposed first and second ends. The first end of the rod can be configured for secure coupling to the base portion of the frame.

Additionally, the hoist spooling assembly includes first and second bushings configured for receipt within the respective openings of the first and second support portions of the frame. The first and second bushings can define respective openings.

The hoist spooling assembly further includes first and second arms having respective proximal and distal portions. The proximal portions of the first and second arms can define respective openings.

The hoist spooling assembly also includes an elongate suspension unit defining a central bore and a retainer defining at least one opening configured to receive at least a portion of the elongate suspension unit. The retainer can be configured for adjustable coupling to the second end of the rod.

Further, the hoist spooling assembly includes an elongate shaft having a longitudinal axis and opposed first and second end portions. The elongate shaft can be configured for receipt within the central bore of the elongate suspension unit such that the first and second end portions of the elongate shaft extend from the central bore of the elongate suspension unit and the longitudinal axis of the elongate shaft is substantially perpendicular to the longitudinal axis of the rod.

The hoist spooling assembly can additionally include first and second spacer tubes. The first spacer tube can be configured to receive the first end portion of the elongate shaft, while the second spacer tube can be configured to receive the second end portion of the elongate shaft.

The hoist spooling assembly still further includes a roller coupled to and positioned between the distal portions of the first and second arms. The roller can be configured for engagement with the cable.

In an operative position of the hoist spooling assembly, the first end portion of the elongate shaft can extend through the first spacer tube and the opening of the first bushing such that at least a portion of the first end portion is positioned within the opening of the proximal portion of the first arm and the second end portion of the elongate shaft extends through the second spacer tube and the opening of the second bushing such that at least a portion of the second end portion is positioned within the opening of the proximal portion of the second arm. In the operative position, the proximal portion of the first arm can be configured for secure coupling to the first end portion of the elongate shaft, and the proximal portion of the second arm can be configured for secure coupling to the second end portion of the elongate shaft.

At least one of the described hoist spooling assemblies can be incorporated into a hoist spooling system including a cable and a drum. Methods of using the described hoist spooling assemblies and systems are also disclosed.

BRIEF DESCRIPTION OF THE DRAWINGS

These and other features of the preferred embodiments of the invention will become more apparent in the detailed description in which reference is made to the appended drawings wherein.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a rod" can include two or more such rods unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the terms "securely coupled" and "secure coupling" can optionally refer to elements that are rigidly coupled to one another or configured for rigid coupling to one another such that there is no relative movement between the elements.

Figure 4:
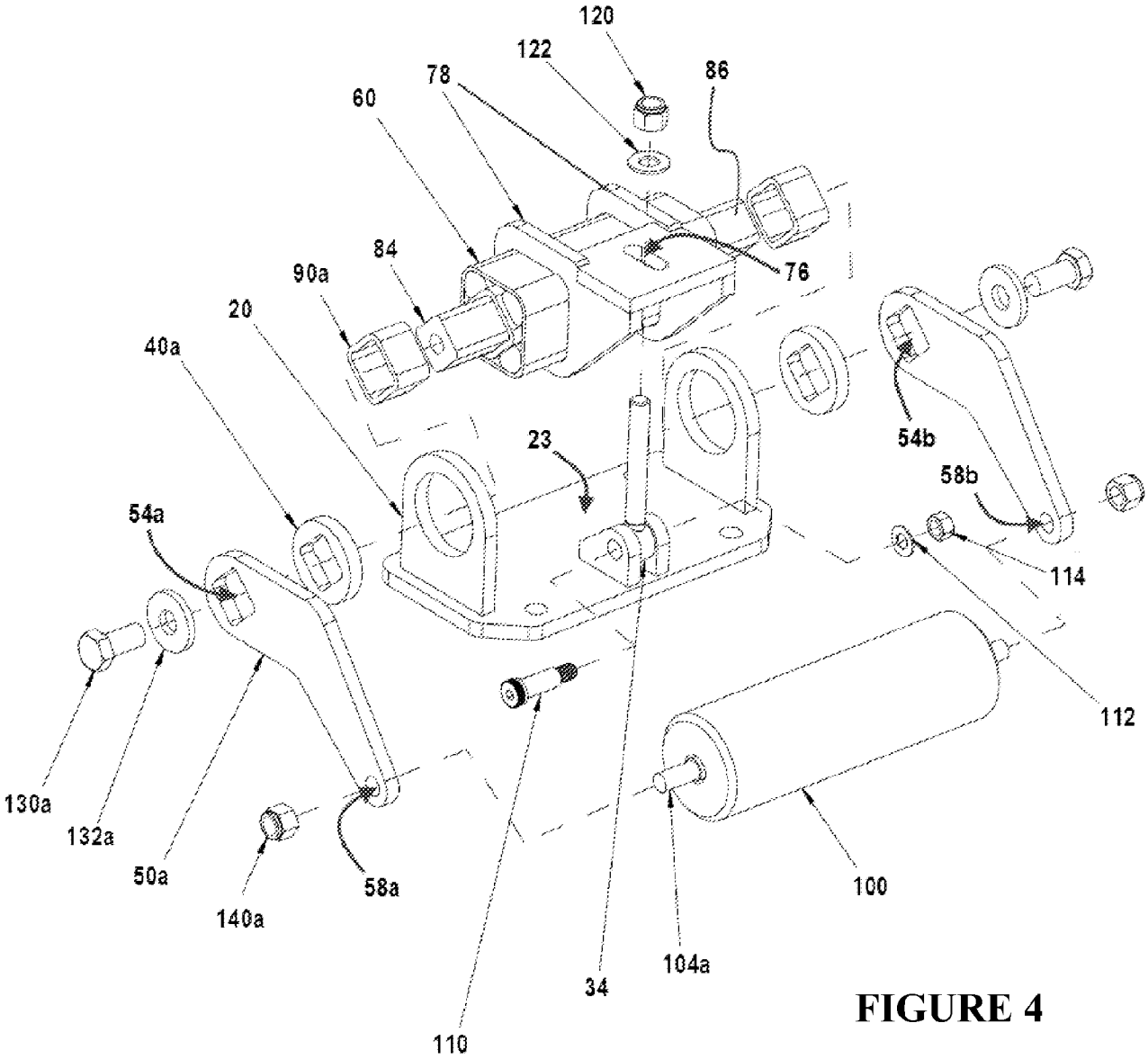
FIG. 4 is a partially exploded view of the hoist spooling assembly of FIG. 3.
Figure 5:
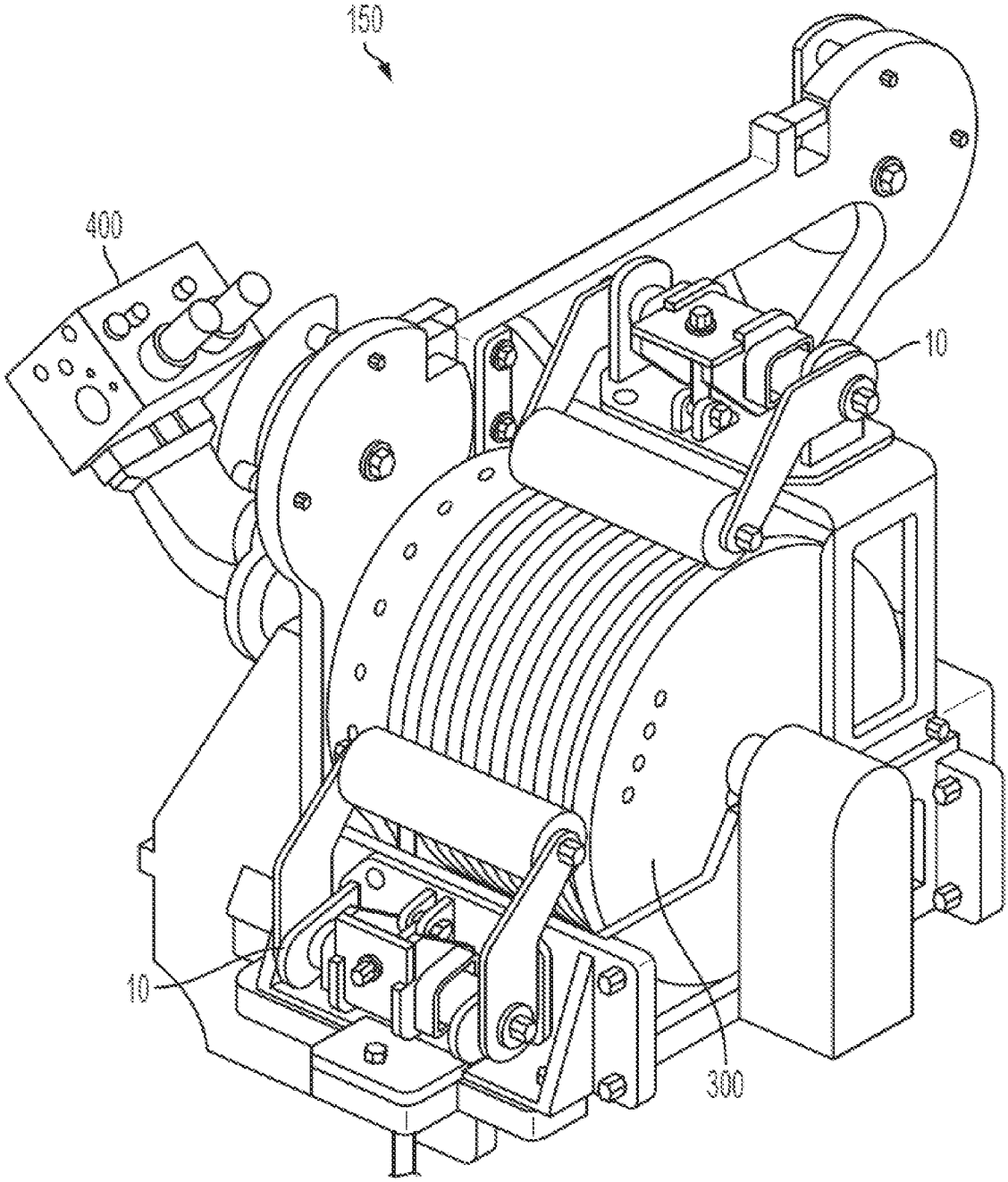
FIG. 5 is a perspective view of an exemplary hoist spooling system as described herein.
Figure 6:
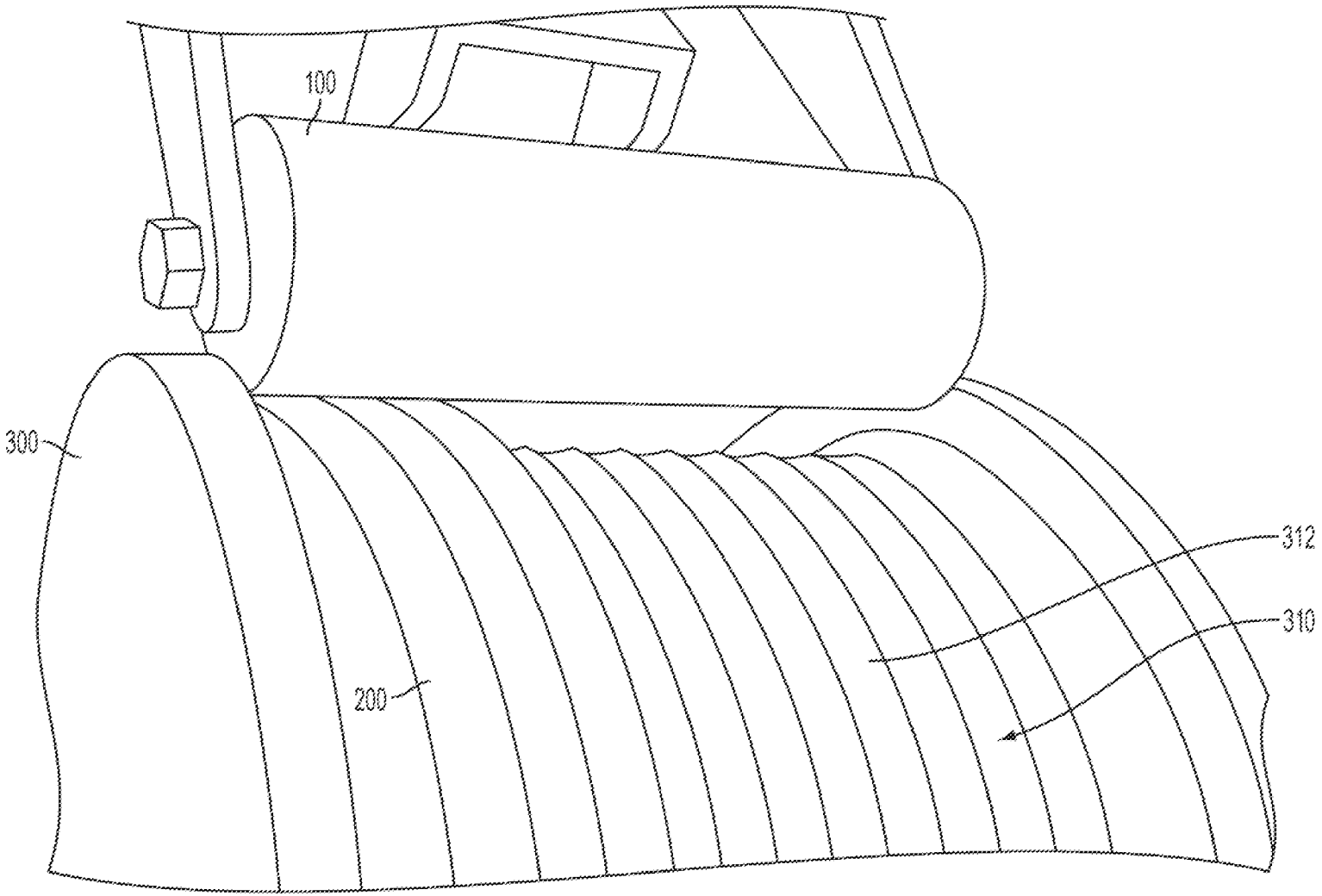
FIG. 6 is close-up view of the drum of the hoist spooling system of FIG. 5.

Described herein with reference to FIGS. 1-6 is a hoist spooling assembly 10 for spooling a cable 200 about a drum 300. In exemplary aspects, the cable 200 can be a hoist cable, such as those used in conventional drilling operations. However, it is contemplated that the disclosed spooling assembly and spooling system can be used to spool any conventional cable and/or rope. In additional aspects, the drum 300 can be substantially cylindrical and can define an outer surface 310. Optionally, it is contemplated that the outer surface 310 can be a grooved surface. For example, as shown in FIG. 6, the outer surface 310 can define a groove 312 that is configured to receive and retain the cable 200, thereby reducing the occurrence of loops and kinks in the cable. In exemplary aspects, the groove 312 can be defined in a helical pattern on the outer surface 310 of the drum 300 such that the groove is a continuous groove extending from a first end of the hoist drum to a second, opposed end of the hoist drum. In yet another aspect, the groove 312 can have a groove diameter sized to correspond to a diameter of the cable 200. For example, the groove diameter can be substantially equal to or slightly larger than the diameter of the cable 200 so that the cable can be positioned in the groove 312. It is contemplated that the groove 312 can comprise at least one groove sidewall configured to separate one course of the groove from an adjacent course of the groove.

In one aspect, the groove 312 and/or the groove sidewall can position the cable 200 around the drum 300 in an orderly and/or repeatable manner. For example, the groove 312 and/or the groove sidewall can position a portion of the cable 200 around the drum 300 in a single layer of cable that is positioned in the groove. It is contemplated that the groove 312 can be further configured to prevent undesired movement of the cable 200 toward a center portion of the outer surface 310 of the drum 300 (as often occurs in known spooling systems). In exemplary aspects, it is contemplated that one or more of the disclosed hoist spooling assemblies 10 can be provided in the form of a hoist spooling system 150, including the cable 200 as well as the drum 300.

In one aspect, and with reference to FIGS. 1-4, the hoist spooling assembly 10 can comprise a frame 20 having a base portion 22 and first and second spaced support portions 26*a*, 26*b*. In this aspect, the base portion 22 can have a top surface 23. In another aspect, the first and second support portions 26*a*, 26*b* can extend upwardly from the top surface 23 of the base portion 22. In this aspect, it is contemplated that the first and second support portions 26*a*, 26*b* can define respective openings 28*a*, 28*b*. In exemplary aspects, the base portion 22 of the frame 20 can comprise first and second spaced braces 24*a*, 24*b* extending upwardly from the top surface 23 of the base portion. In these aspects, the first and second spaced braces 24*a*, 24*b* can define respective openings 25*a*, 25*b*. It is contemplated that the frame 20 can provide structural rigidity for the mounting of the various components of the assembly 10 described herein. It is further contemplated that the frame 20 can be configured to support roller reaction forces. It is still further contemplated that the frame 20 can be configured to provide a mounting interface with a crown block installation, such as those crown block installations conventionally known in the art.

In an additional aspect, and with reference to FIGS. 1-4, the hoist spooling assembly 10 can comprise a rod 30 having a longitudinal axis 32 and opposed first and second ends 34, 36. In this aspect, it is contemplated that the first end 34 of the rod 30 can be configured for secure coupling to the base portion 22 of the frame 20. In exemplary aspects, the first end 34 of the rod 30 can define a transverse opening 35 extending substantially perpendicular to the longitudinal axis 32 of the rod. In these aspects, the transverse opening 35 of the rod 30 can be configured for alignment with the openings 25*a*, 25*b* of the first and second braces 24*a*, 24*b* of the base portion 22 of the frame 20. Optionally, as shown in FIGS. 1-4, the first end 34 of the rod 30 can have a substantially rounded shape.

Figure 2:
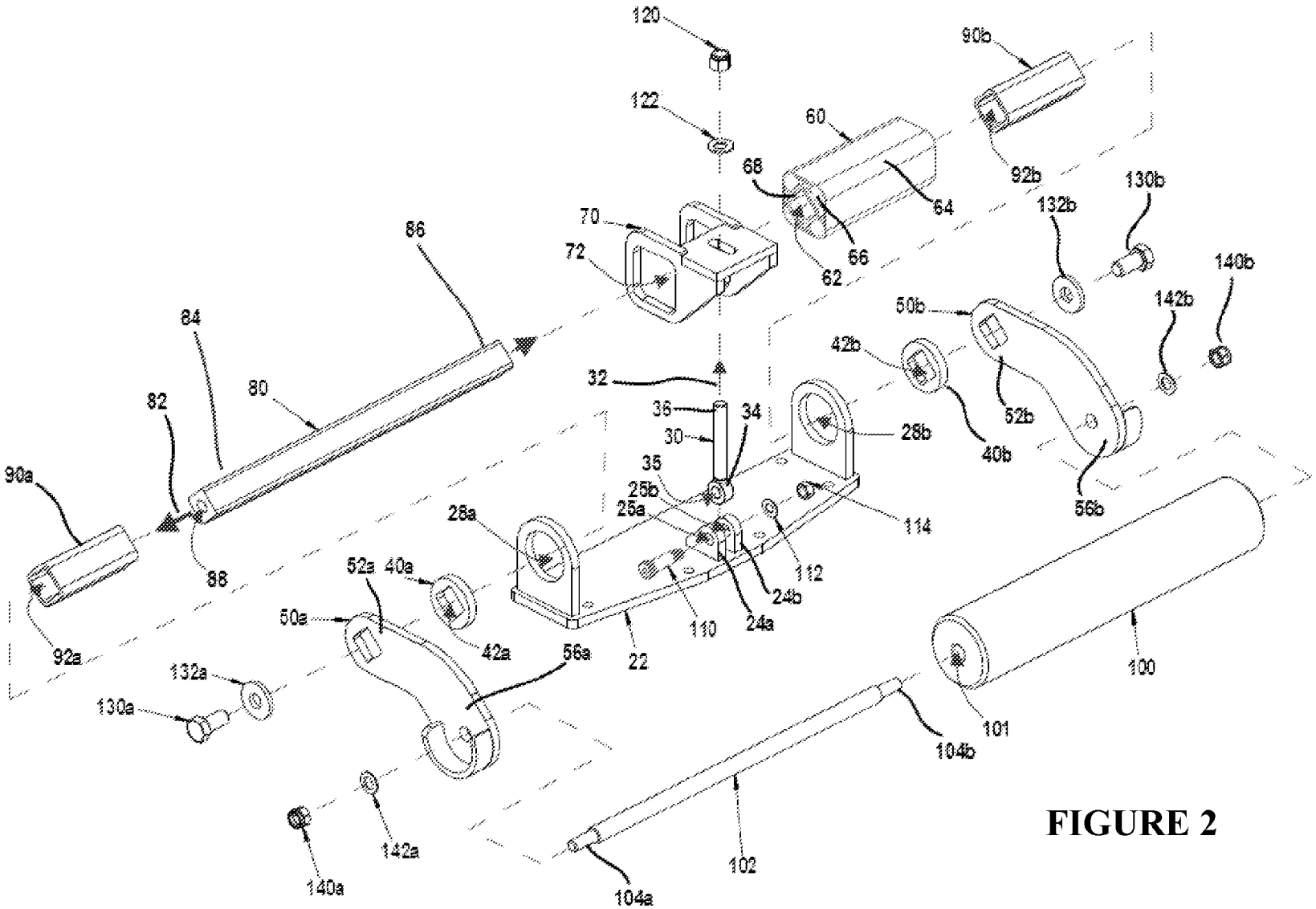
FIG. 2 is an exploded view of the hoist spooling assembly of FIG. 1.
Figure 3:
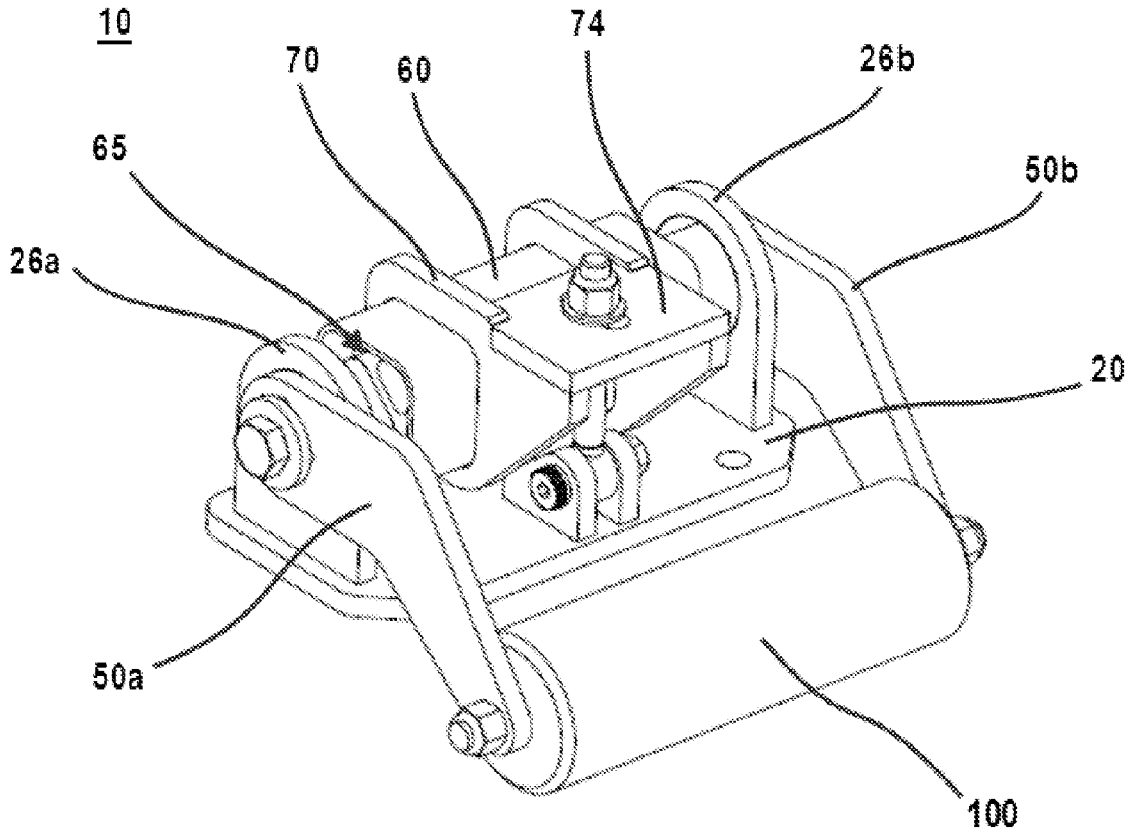
FIG. 3 is a perspective view of another exemplary hoist spooling assembly as described herein.

In a further aspect, and with reference to FIGS. 2 and 4, the hoist spooling assembly 10 can further comprise first and second bushings 40*a*, 40*b*. In this aspect, the first and second bushings 40*a*, 40*b* can be configured for receipt within the respective openings 28*a*, 28*b* of the first and second support portions 26*a*, 26*b* of the frame 20. In exemplary aspects, the first and second bushings 40*a*, 40*b* can define respective openings 42*a*, 42*b*. In these aspects, it is contemplated that the openings 42*a*, 42*b* of the bushings 40*a*, 40*b* can optionally have a substantially rectangular shape. It is further contemplated that the openings 42*a*, 42*b* of the bushings 40*a*, 40*b* can optionally have a substantially square shape.

Figure 1:
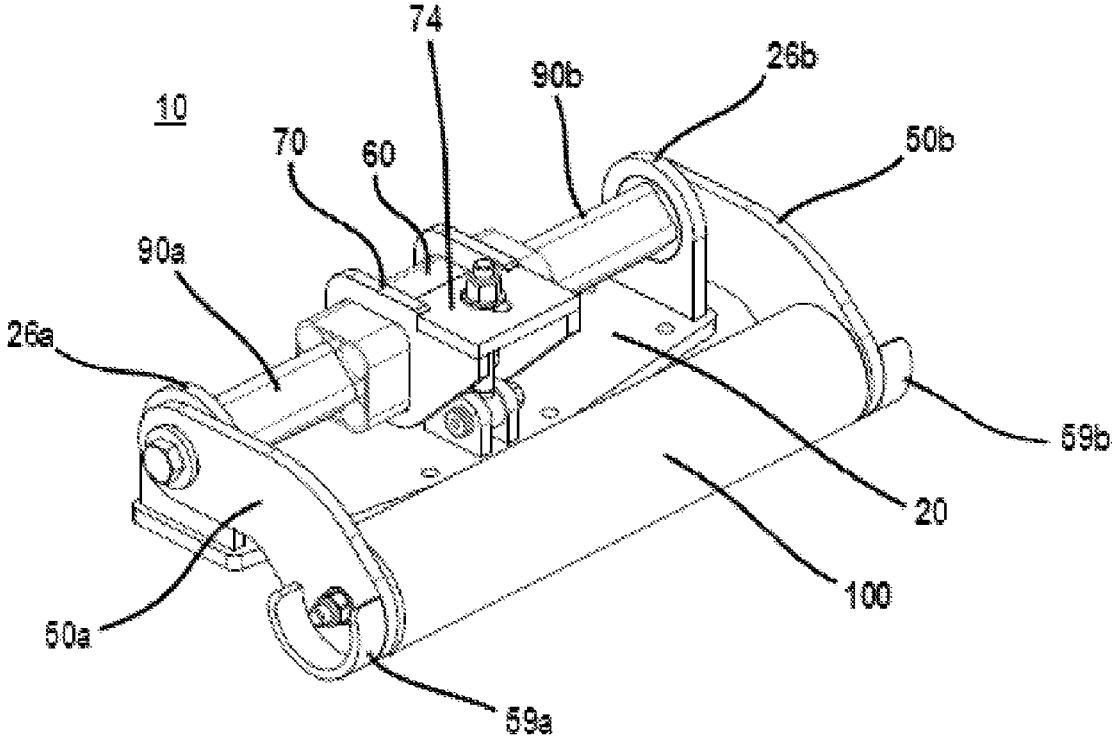
FIG. 1 is a perspective view of an exemplary hoist spooling assembly as described herein.

As shown in FIGS. 1-4, in another aspect, the hoist spooling assembly 10 can further comprise first and second arms 50*a*, 50*b* having respective proximal portions 52*a*, 52*b* and distal portions 56*a*, 56*b*. In this aspect, the proximal portions 52*a*, 52*b* of the first and second arms 50*a*, 50*b* can define respective openings 54*a*, 54*b*. Optionally, the openings 54*a*, 54*b* of the proximal portions 52*a*, 52*b* can have a shape substantially corresponding to the shapes of the openings 42*a*, 42*b* of the first and second bushings 40*a*, 40*b*. In another aspect, the distal portions 56*a*, 56*b* of the first and second arms 50*a*, 50*b* can define respective openings 58*a*, 58*b*. Optionally, in exemplary aspects, the first and second arms 50*a*, 50*b* can comprise respective lip portions 59*a*, 59*b* extending at least partially about the openings 58*a*, 58*b* of the first and second arms 50*a*, 50*b*. In these aspects, as shown in FIGS. 1-2, the lip portions 59*a*, 59*b* can extend outwardly relative to an outer surface of the arms 50*a*, 50*b*.

In still another aspect, and as shown in FIGS. 1-4, the hoist spooling assembly 10 can further comprise an elongate suspension unit 60 defining a central bore 62. In this aspect, it is contemplated that the bore 62 can have a substantially rectangular shape. It is further contemplated that the bore 62 can have a substantially square shape. In an exemplary aspect, the elongate suspension unit 60 can comprise an outer element 64 defining a central chamber 65. In this aspect, the elongate suspension unit 60 can further comprise a at least one support element 66 positioned within the central chamber 65. It is contemplated that the elongate suspension unit 60 can still further comprise an inner element 68 supported by the at least one support element 66 within the central chamber 65. It is further contemplated that the inner element 68 can define the central bore 62 of the elongate suspension unit 60. Optionally, it is contemplated that the at least one support element 66 can comprise a plurality of support elements spaced about the periphery of the inner element 68. In exemplary aspects, the plurality of support elements 66 can comprise four spaced support elements, as shown in FIGS. 2 and 4. In other exemplary aspects, each support element 66 of the at least one support element can comprise a flexible and/or resilient material such that the support elements function as a spring. In other exemplary aspects, it is contemplated that the elongate suspension unit 60 can be a ROSTA rubber suspension unit system (ROSTA AG). However, it is contemplated that any known elongate suspension unit can be employed within the disclosed hoist spooling assembly 10.

In an additional aspect, and with reference to FIGS. 1-4, the hoist spooling assembly 10 can further comprise a retainer 70 defining at least one opening 72 configured to receive at least a portion of the elongate suspension unit 60. In exemplary aspects, the retainer 70 can be configured for adjustable coupling to the second end 36 of the rod 30. In another aspect, the retainer 70 can comprise a platform 74 defining a slot 76 configured to receive the second end 36 of the rod 30. In one exemplary aspect, as shown in FIG. 2, the retainer can comprise a pair of spaced retention arms 78 defining two respective openings 72. In this aspect, the platform 74 can be secured to and span between the respective retention arms 78. However, it is contemplated that the retainer 70 can have any configuration permitting receipt of the second end 36 of the rod 30 by the slot 76 of the platform 74.

In a further aspect, and with reference to FIGS. 2 and 4, the hoist spooling assembly 10 can further comprise an elongate shaft 80 having a longitudinal axis 82 and opposed first and second end portions 84, 86. In this aspect, the elongate shaft 80 can be configured for receipt within the central bore 62 of the elongate suspension unit 60 such that the first and second end portions 84, 86 of the elongate shaft extend from the central bore of the elongate suspension unit and the longitudinal axis 82 of the elongate shaft is substantially perpendicular to the longitudinal axis 32 of the rod 30. Thus, it is contemplated that the elongate shaft 80 can have a substantially rectangular or substantially square cross-section. In exemplary aspects, the elongate shaft 80 can define a bore 88 extending substantially parallel to the longitudinal axis 82 of the elongate shaft.

As shown in FIGS. 1-4, and in still a further aspect, the hoist spooling assembly 10 can further comprise first and second spacer tubes 90*a*, 90*b*. In this aspect, it is contemplated that an opening 92*a* of the first spacer tube 90*a* can be configured to receive the first end portion 84 of the elongate shaft 80, and an opening 92*b* of the second spacer tube 90*b* can be configured to receive the second end portion 86 of the elongate shaft.

In another aspect, and with reference to FIGS. 1-6, the hoist spooling assembly 10 can further comprise a roller 100 securely coupled to and positioned between the distal portions 56*a*, 56*b* of the first and second arms 50*a*, 50*b*. In this aspect, it is contemplated that the roller 100 can be configured for engagement with the cable 200. Optionally, in exemplary aspects, the roller 100 can be a one-piece roller. In these aspects, it is contemplated that the one-piece roller can eliminate the problem of the cable 200 getting caught in gaps defined by the roller, as commonly occurred within two- or three-piece rollers known in the art. In exemplary aspects, the roller 100 can comprise a material having a relatively high stiffness, such as, for example and without limitation, Nylatron® GSM nylon (Professional Plastics, Inc.). In an additional aspect, the roller 100 can define a bore 101 configured to receive a roller shaft 102. In this aspect, the roller shaft 102 can have first and second end portions 104*a*, 104*b*. It is contemplated that, upon positioning of the roller shaft 102 within the bore 101, the first and second end portions 104*a*, 104*b* of the shaft can be configured to extend from the roller 100, as shown in FIG. 4. It is further contemplated that the first and second end portions 104*a*, 104*b* can have a reduced outer diameter relative to the remaining portions of the shaft 102.

It is contemplated that various known fasteners and coupling mechanisms can be used to adjustably secure the components of the hoist spooling assembly 10 in an operative position. For example, a known fastener and/or coupling mechanism can be used to operatively couple: (a) the elongate shaft 80 to the first and second arms 50*a*, 50*b*; (b) the shaft 102 of the roller 100 to the first and second arms 50*a*, 50*b*; (c) the base portion 22 of the frame 20 to the rod 30; and (d) the rod 30 to the retainer 70.

In one exemplary aspect, as shown in FIGS. 2 and 4, the hoist spooling assembly 10 can comprise a torque nut 120 configured to adjustably couple the second end 36 of the rod 30 to the retainer 70. In exemplary aspects, after the second end 36 of the rod 30 is passed through the slot 76 defined by the platform 74 of the retainer 70, the torque nut 120 can be configured for threaded engagement with the second end of the rod and further configured for advancement toward the platform of the retainer. In additional exemplary aspects, the torque nut 120 can be a ⅝"-11 UNC 3B nyloc lock nut. Optionally, the hoist spooling assembly 10 can further comprise a washer 122 configured for positioning on the rod 30 such that the washer is positioned between the torque nut 120 and the platform 74 of the retainer. It is contemplated that the washer 122 can have an outer diameter that is greater than a width of the slot 76 of the platform 74. In exemplary aspects, the washer 122 can be a ⅝ GR 8 flat washer. It is further contemplated that washer 122 can be configured to cover the slot 76 of the retainer 70 and provide a flat mating surface for the torque nut 120. In use, it is contemplated that the torque nut 120 can be configured to adjustably apply a torsional force to the suspension unit 60 and/or the elongate shaft 80 through the retainer 70. More specifically, it is contemplated that the torque nut 120 can be configured to selectively apply torque to the support elements 66 of the suspension unit 60, thereby adjusting the flexion of the support elements of the suspension unit.

In another exemplary aspect, the hoist spooling assembly 10 can further comprise a pin 110 configured to securely couple the first end 34 of the rod 30 to the frame 20. In this aspect, it is contemplated that, in the operative position, the first end 34 of the rod 30 can be positioned between the first and second braces 24*a*, 24*b*, and the transverse opening 35 of the rod and the openings 25*a*, 25*b* of the first and second braces can be configured to receive the pin 110. In exemplary aspects, the pin 110 can be a shoulder bolt, such as, for example and without limitation, a ⅝-13 UNC shoulder bolt having a length of about 0.5 inches. Optionally, the hoist spooling assembly 10 can further comprise a washer 112 and a nut 114 positioned thereon a portion of the pin 110 extending from the opening 25*b* of the second brace 24*b*. It is contemplated that the washer 112 can be positioned on the pin 110 in between the nut 114 and the second brace 24*b*, with the nut being configured for threaded engagement with the exposed end portion of the pin. In exemplary aspects, the washer 112 can be a ½" GR 8 flat washer, and the nut 114 can be a ½"-13 UNC 3B hex nut.

In a further exemplary aspect, the hoist spooling assembly 10 can further comprise first and second bolts 130*a*, 130*b* configured for insertion within the bore 88 of the elongate shaft 80. In this aspect, the first bolt 130*a* can be configured for insertion within the first end portion 84 of the shaft 80, and the second bolt 130*b* can be configured for insertion within the second end portion 86 of the shaft. In exemplary aspects, the first and second bolts 130*a*, 130*b* can be hex head cap screws, such as, for example and without limitation, ¾-10 UNC GR8 hex head cap screws with a length of about 1.5 inches. Optionally, it is contemplated that the hoist spooling assembly 10 can further comprise first and second washers 132*a*, 132*b* that are configured for positioning between the first and second bolts 130*a*, 130*b* and the proximal portions 52*a*, 52*b* of the first and second arms 50*a*, 50*b*. In exemplary aspects, the first and second washers 132*a*, 132*b* can be ¾" fender washers.

In still another exemplary aspect, the hoist spooling assembly 10 can further comprise first and second nuts 140*a*, 140*b* configured for engagement with the first and second end portions 104*a*, 104*b* of the shaft 102 of the roller 100. In this aspect, as shown in FIG. 2, it is contemplated that the first and second end portions 104*a*, 104*b* of the shaft 102 can be configured to extend through the openings 58*a*, 58*b* of the distal portions 56*a*, 56*b* of the first and second arms 50*a*, 50*b*. In exemplary aspects, the first and second nuts 140*a*, 140*b* can be nyloc nuts. Optionally, it is further contemplated that the hoist spooling assembly 10 can further comprise first and second washers 142*a*, 142*b* that are configured for positioning between the first and second nuts 140*a*, 140*b* and the distal portions 56*a*, 56*b* of the first and second arms 50*a*, 50*b*.

In the operative position of the hoist spooling assembly 10, it is contemplated that the first end portion 84 of the elongate shaft 80 can extend through the opening 92*a* of the first spacer tube 90*a* and the opening 42*a* of the first bushing 40*a* such that at least a portion of the first end portion is positioned within the opening 54*a* of the proximal portion 52*a* of the first arm 50*a*, and the second end portion 86 of the elongate shaft can extend through the opening 92*b* of the second spacer tube 90*b* and the opening 42*b* of the second bushing 40*b* such that at least a portion of the second end portion is positioned within the opening 54*b* of the proximal portion 52*b* of the second arm 50*b*. In the operative position, it is further contemplated that the proximal portion 52*a* of the first arm 50*a* can be configured for secure coupling to the first end portion 84 of the elongate shaft, and the proximal portion 52*b* of the second arm 50*b* can be configured for secure coupling to the second end portion 86 of the elongate shaft 80. In the operative position, it is still further contemplated that the proximal portion 52*a* of the first arm 50*a* can be rigidly secured to the first end portion 84 of the elongate shaft 80, and the proximal portion 52*b* of the second arm 50*b* can be rigidly secured to the second end portion 86 of the elongate shaft. It is contemplated that the rigid engagement between the first and second arms 50*a*, 50*b* and the elongate shaft 80 can overcome the inherent compliance of the suspension unit 60 to provide for improved delivery of force throughout the assembly (and to a cable). In the operative position, it is still further contemplated that the first and second bushings 40*a*, 40*b* can be positioned within the first and second openings 28*a*, 28*b* of the first and second support portions 26*a*, 26*b* of the frame 20.

In operation, it is contemplated that the retainer 70 can be configured to transform axial clamping forces of the torque nut 120 into a moment that is applied to the suspension unit 60. It is contemplated that the suspension unit 60 can undergo an angular deflection in response to the torque transferred by the retainer 70. It is further contemplated that the retainer 70 can be configured to retain a desired torsion force on the suspension unit 60 by preventing movement of the suspension unit such that the suspension unit maintains a deflected position. It is still further contemplated that the reaction forces within the suspension unit 60 can be configured to transmit torque to the elongate shaft 80. The elongate shaft 80, in turn, can be configured to transmit the torque from the suspension unit 80 to the first and second arms 50*a*, 50*b* and, ultimately, to the cable 200.

In operation, the first and second spacer tubes 90*a*, 90*b* can be configured to restrict lateral movement of the suspension unit 60 while also retaining the first and second bushings 40*a*, 40*b* in engagement with (or proximate thereto) the first and second support portions 26*a*, 26*b* of the frame 20. It is contemplated that the first and second bushings 40*a*, 40*b* can provide support for the elongate shaft 80 while also permitting adjustable articulation of the first and second arms 50*a*, 50*b*. It is further contemplated that the first and second arms 50*a*, 50*b* can be configured to transmit the torque from the elongate shaft 80 to the shaft 102 of the roller 100, and the shaft 102 can be configured to transmit the torque to the roller itself. It is still further contemplated that the washers 132*a*, 132*b* can be configured to ensure that the first and second arms 50*a*, 50*b* remain in substantially constant contact with the elongate shaft 80 at all times by preventing the elongate shaft from shifting out of position. It is still further contemplated that the washers 132*a*, 132*b* can be configured to cover at least a portion of openings 54*a*, 54*b*, thereby providing a flat surface for fastening first and second bolts 130*a*, 130*b*. The first and second bolts 130*a*, 130*b* can be configured to provide a clamping force sufficient to retain the first and second arms 50*a*, 50*b* in engagement with the frame 20 while locking the elongate shaft 80 in a desired position.

In operation, the first end 34 of the rod 30 can be configured for pivotal rotation about the pin 110 as the suspension unit 60 is deflected. It is contemplated that the pin 110 can be configured to act such that the longitudinal axis 32 of the rod 30 remains substantially perpendicular to the top and bottom surfaces of the platform 74 of the retainer 70 throughout its range of pivotal motion. It is further contemplated that the nut 114 can be configured to retain the pin 110 in engagement with a portion of the frame 20, such as, for example and without limitation, braces 24*a*, 24*b*.

In operation, the torque nut 120 can be configured to permit an operator to adjustably apply a selected level of torsion force to the suspension unit 60 while also ensuring that the energy stored in the suspension unit is not released. It is further contemplated that the torque nut 120 can permit ergonomic adjustment of the level of torque applied to the suspension unit 60.

In operation, the roller 100 can be configured to transmit the radial force to the cable 200 that is spooled on the drum 300. It is contemplated that the roller can be configured to reduce the wear and frictional forces applied to the cable 200, thereby allowing the cable to be unwound from the drum with minimal kink and/or loop formation. It is further contemplated that the shaft 102 of the roller 100 can act as an axle upon which the roller rotates. It is still further contemplated that the shaft 102 can effectively join the first and second arms 50*a*, 50*b* together such that the force is evenly applied to the cable 200.

In exemplary aspects, the hoist spooling system 150 can comprise conventional processing means 400 for effecting selective positioning of the at least one hoist spooling assembly 10 relative to the outer surface 310 of the drum 300. In these aspects, it is contemplated that the processing means 400 can comprise, for example and without limitation, a processor in communication with a memory and a user interface. It is further contemplated that the processing means 400 can be in operative communication with each hoist spooling assembly 10 of the hoist spooling system 150.

In exemplary aspects, as shown in FIG. 5, the at least one hoist spooling assembly 10 of the hoist spooling system 150 can comprise a plurality of hoist spooling assemblies. In these aspects, it is contemplated that the plurality of hoist spooling assemblies can comprise three hoist spooling assemblies. It is further contemplated that the plurality of hoist spooling assemblies can be substantially equally spaced about the outer surface 310 of the drum 300. In various aspects, it is contemplated that a first spooling assembly of the plurality of spooling assemblies 10 can be positioned proximate a location where the cable 200 makes initial contact with the outer surface 310 of the drum 300. In these aspects, it is contemplated that the placement of the first spooling assembly in this location can ensure that slack within the cable 200 is present in the relatively straight portion of the cable (before the cable contacts the drum) rather than in the curved portion of the cable (around the drum). In additional aspects, the roller 100 of each hoist spooling assembly 10 of the system 150 can be configured to press the cable 200 against the outer surface 310 of the drum 300, thereby increasing frictional engagement between the cable and the outer surface of the drum and limiting undesired movement of the cable.

In exemplary aspects, it is contemplated that the hoist spooling assembly 10 and/or the hoist spooling system 150 can be configured for operation with a hoist limiting system, such as the hoist limiting system described in co-pending U.S. patent application Ser. No. 13/718,026, filed on Dec. 18, 2012 and entitled "Hoist Limiting Systems and Methods," which is incorporated by reference herein in its entirety.

In use, and with reference to FIGS. 1-6, the disclosed assemblies 10 and systems 150 can be employed in a method of spooling the cable about the drum. In one aspect, the method can comprise positioning the cable in engagement with the outer surface of the drum. In another aspect, the method can comprise operatively positioning at least one spooling assembly relative to the cable and the drum.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A hoist spooling assembly for spooling a cable about a drum, comprising:

a frame having a base portion and first and second spaced support portions, the base portion having a top surface, the first and second support portions extending upwardly from the top surface of the base portion and defining respective openings;

a rod having a longitudinal axis and opposed first and second ends, the first end of the rod being configured for secure coupling to the base portion of the frame;

first and second bushings configured for receipt within the respective openings of the first and second support portions of the frame, the first and second bushings defining respective openings;

first and second arms having respective proximal and distal portions, the proximal portion of the first and second arms defining respective openings;

an elongate suspension unit defining a central bore having a prescribed geometric cross-sectional shape;

a retainer defining at least one opening configured to receive at least a portion of the elongate suspension unit, the retainer configured for adjustable coupling to the second end of the rod;

an elongate shaft having a longitudinal axis and opposed first and second end portions, the elongate shaft having an external surface configured for receipt within the central bore of the elongate suspension unit such that the first and second end portions of the elongate shaft extend from the central bore of the elongate suspension unit and the longitudinal axis of the elongate shaft is substantially perpendicular to the longitudinal axis of the rod and is substantially co-axial with a longitudinal axis of the central bore of the elongate suspension unit, wherein at least the portion of the external surface of the elongate shaft received within the central bore has a complementary geometric cross-sectional shape to the prescribed geometric cross-sectional shape of the central bore;

first and second spacer tubes, the first spacer tube configured to receive the first end portion of the elongate shaft, the second spacer tube configured to receive the second end portion of the elongate shaft; and a roller securely coupled to and positioned between the distal portions of the first and second arms, the roller being configured for engagement with the cable, wherein, in an operative position of the hoist spooling assembly, the first end portion of the elongate shaft extends through the first spacer tube and the opening of the first bushing such that at least a portion of the first end portion is positioned within the opening of the proximal portion of the first arm and the second end portion of the elongate shaft extends through the second spacer tube and the opening of the second bushing such that at least a portion of the second end portion is positioned within the opening of the proximal portion of the second arm, wherein, in the operative position, the proximal portion of the first arm is configured for secure coupling to the first end portion of the elongate shaft, and the proximal portion of the second arm is configured for secure coupling to the second end portion of the elongate shaft, and wherein the elongate suspension unit the elongate suspension unit selectively transmits angular torque to the elongate shaft, which in turn, transmits the angular torque to the coupled first and second arms and hence to the cable.

2. The hoist spooling assembly of claim 1, wherein the elongate suspension unit comprises:

an outer element defining a central chamber;

a plurality of support elements positioned within the central chamber; and an inner element supported by the plurality of support elements within the central chamber, the inner element defining the central bore of the elongate suspension unit.

3. The hoist spooling assembly of claim 2, wherein the plurality of support elements comprise a flexible material.

4. The hoist spooling assembly of claim 1, wherein the retainer comprises a platform defining a slot configured to receive the second end of the rod.

5. The hoist spooling assembly of claim 4, further comprising a torque nut configured to adjustably couple the retainer to the second end of the rod.

6. The hoist spooling assembly of claim 1, wherein the roller is a one-piece roller.

7. The hoist spooling assembly of claim 1, wherein, in the operative position, the proximal portion of the first arm is rigidly secured to the first end portion of the elongate shaft, and the proximal portion of the second arm is rigidly secured to the second end portion of the elongate shaft.

8. The hoist spooling assembly of claim 1, further comprising a pin configured to securely couple the first end of the rod to the frame, wherein the base portion of the frame comprises first and second spaced braces extending upwardly from the top surface of the base portion, the first and second spaced braces defining respective openings, wherein the first end of the rod defines a transverse opening extending substantially perpendicular to the longitudinal axis of the rod, and wherein, in the operative position, the first end of the rod is positioned between the first and second braces, and the transverse opening of the rod and the openings of the first and second braces are configured to receive the pin.

9. A hoist spooling system, comprising:

a drum having an outer surface;

a cable configured for engagement with the outer surface of the drum; and at least one spooling assembly, each spooling assembly of the at least one spooling assembly comprising:

a frame having a base portion and first and second spaced support portions, the base portion having a top surface, the first and second support portions extending upwardly from the top surface of the base portion and defining respective openings;

a rod having a longitudinal axis and opposed first and second ends, the first end of the rod being configured for secure coupling to the base portion of the frame;

first and second bushings configured for receipt within the respective openings of the first and second support portions of the frame, the first and second bushings defining respective openings;

first and second arms having respective proximal and distal portions, the proximal portion of the first and second arms defining respective openings;

an elongate suspension unit defining a central bore having a prescribed geometric cross-sectional shape;

a retainer defining at least one opening configured to receive at least a portion of the elongate suspension unit, the retainer configured for adjustable coupling to the second end of the rod;

an elongate shaft having a longitudinal axis and opposed first and second end portions, the elongate shaft configured for receipt within the central bore of the elongate suspension unit such that the first and second end portions of the elongate shaft extend from the central bore of the elongate suspension unit and the longitudinal axis of the elongate shaft is substantially perpendicular to the longitudinal axis of the rod and is substantially co-axial with a longitudinal axis of the central bore of the elongate suspension unit wherein at least the portion of the external surface of the elongate shaft received within the central bore has a complementary geometric cross-sectional shape to the prescribed geometric cross-sectional shape of the central bore;

first and second spacer tubes, the first spacer tube configured to receive the first end portion of the elongate shaft, the second spacer tube configured to receive the second end portion of the elongate shaft; and a roller securely coupled to and positioned between the distal portions of the first and second arms, the roller being spaced a selected distance from the outer surface of the drum and being configured for engagement with the cable, wherein, in an operative position of the spooling assembly, the first end portion of the elongate shaft extends through the first spacer tube and the opening of the first bushing such that at least a portion of the first end portion is positioned within the opening of the proximal portion of the first arm and the second end portion of the elongate shaft extends through the second spacer tube and the opening of the second bushing such that at least a portion of the second end portion is positioned within the opening of the proximal portion of the second arm, and wherein, in the operative position, the proximal portion of the first arm is configured for secure coupling to the first end portion of the elongate shaft, and the proximal portion of the second arm is configured for secure coupling to the second end portion of the elongate shaft, and wherein the elongate suspension unit the elongate suspension unit selectively transmits angular torque to the elongate shaft which in turn, transmits the angular torque to the coupled first and second arms and hence to the cable.

10. The hoist spooling system of claim 9, wherein the elongate suspension unit of each spooling assembly comprises:

an outer element defining a central chamber;

a plurality of support elements positioned within the central chamber; and an inner element supported by the plurality of support elements within the central chamber, the inner element defining the central bore of the elongate suspension unit.

11. The hoist spooling system of claim 10, wherein the plurality of support elements comprise a flexible material.

12. The hoist spooling system of claim 10, wherein the retainer of each spooling assembly comprises a platform defining a slot configured to receive the second end of the rod.

13. The hoist spooling system of claim 12, wherein each spooling assembly further comprises a torque nut configured to adjustably couple the retainer to the second end of the rod.

14. The hoist spooling system of claim 9, wherein the roller of each spooling assembly is a one-piece roller.

15. The hoist spooling system of claim 9, wherein, in the operative position of each spooling assembly, the proximal portion of the first arm is rigidly secured to the first end portion of the elongate shaft, and the proximal portion of the second arm is rigidly secured to the second end portion of the elongate shaft.

16. The hoist spooling system of claim 9, wherein each spooling assembly further comprises a pin configured to securely couple the first end of the rod to the frame, wherein the base portion of the frame comprises first and second spaced braces extending upwardly from the top surface of the base portion, the first and second spaced braces defining respective openings, wherein the first end of the rod defines a transverse opening extending substantially perpendicular to the longitudinal axis of the rod, and wherein, in the operative position of each spooling assembly, the first end of the rod is positioned between the first and second braces, and the transverse opening of the rod and the openings of the first and second braces are configured to receive the pin.

17. The hoist spooling system of claim 9, wherein the at least one spooling assembly comprises three spooling assemblies.

18. The hoist spooling system of claim 17, wherein the three spooling assemblies are substantially equally spaced about the outer surface of the drum.

19. The hoist spooling system of claim 9, wherein the outer surface of the drum is a grooved surface.

20. A method of spooling a cable about a drum, comprising:

positioning the cable in engagement with an outer surface of the drum; and operatively positioning at least one spooling assembly relative to the cable and the drum, the spooling assembly comprising:

a frame having a base portion and first and second spaced support portions, the base portion having a top surface, the first and second support portions extending upwardly from the top surface of the base portion and defining respective openings;

a rod having a longitudinal axis and opposed first and second ends, the first end of the rod being configured for secure coupling to the base portion of the frame;

first and second bushings configured for receipt within the respective openings of the first and second support portions of the frame, the first and second bushings defining respective openings;

first and second arms having respective proximal and distal portions, the proximal portion of the first and second arms defining respective openings;

an elongate suspension unit defining a central bore having a prescribed geometric cross-sectional shape;

a retainer defining at least one opening configured to receive at least a portion of the elongate suspension unit, the retainer configured for adjustable coupling to the second end of the rod;

an elongate shaft having a longitudinal axis and opposed first and second end portions, the elongate shaft configured for receipt within the central bore of the elongate suspension unit such that the first and second end portions of the elongate shaft extend from the central bore of the elongate suspension unit and the longitudinal axis of the elongate shaft is substantially perpendicular to the longitudinal axis of the rod and is substantially co-axial with a longitudinal axis of the central bore of the elongate suspension unit wherein at least the portion of the external surface of the elongate shaft received within the central bore has a complementary geometric cross-sectional shape to the prescribed geometric cross-sectional shave of the central bore;

first and second spacer tubes, the first spacer tube configured to receive the first end portion of the elongate shaft, the second spacer tube configured to receive the second end portion of the elongate shaft; and a roller securely coupled to and positioned between the distal portions of the first and second arms, the roller being configured for engagement with the cable, wherein, in an operative position of each hoist spooling assembly, the first end portion of the elongate shaft extends through the first spacer tube and the opening of the first bushing such that at least a portion of the first end portion is positioned within the opening of the proximal portion of the first arm and the second end portion of the elongate shaft extends through the second spacer tube and the opening of the second bushing such that at least a portion of the second end portion is positioned within the opening of the proximal portion of the second arm, and wherein, in the operative position of the hoist spooling assembly, the proximal portion of the first arm is configured for secure coupling to the first end portion of the elongate shaft, and the proximal portion of the second arm is configured for secure coupling to the second end portion of the elongate shaft, selectively transmitting an annular torque force thereon the cable, wherein the elongate suspension unit the elongate suspension unit selectively transmits angular toque to the elongate shaft, which in turn, transmits the angular torque to the coupled first and second arms and hence to the cable.

* * * * *